US009431771B1

(12) United States Patent
Sundarakrishnamachari et al.

(10) Patent No.: US 9,431,771 B1
(45) Date of Patent: Aug. 30, 2016

(54) ELECTROMAGNETICALLY SHIELDED CONNECTOR SYSTEM

(71) Applicant: Delphi Technologies, Inc., Troy, MI (US)

(72) Inventors: Rangarajan Sundarakrishnamachari, Chennai (IN); Jean Razafiarivelo, Rambouillet (FR); Anthony Raschilla, Girard, OH (US)

(73) Assignee: Delphi Technologies, Inc, Troy, MI (US)

( * ) Notice: Subject to any disclaimer, the term of this patent is extended or adjusted under 35 U.S.C. 154(b) by 0 days.

(21) Appl. No.: 14/932,230

(22) Filed: Nov. 4, 2015

(51) Int. Cl.
*H01R 13/648* (2006.01)
*H01R 13/6585* (2011.01)
*H01R 13/514* (2006.01)

(52) U.S. Cl.
CPC ..... *H01R 13/6585* (2013.01); *H01R 13/514* (2013.01)

(58) Field of Classification Search
CPC ..... H01R 13/514; H01R 13/518; H01R 13/6585; H01R 23/688; H01R 23/725; H01R 23/7073
USPC ..... 439/157, 607.05, 607.17, 607.55, 439/607.56
See application file for complete search history.

(56) References Cited

U.S. PATENT DOCUMENTS 8,500,487 B2 * 8/2013 Morgan ..... H01R 13/6587 439/607.06
8,591,260 B2 * 11/2013 Davis ..... H01R 13/6586 439/607.55
8,777,663 B2 * 7/2014 Annis ..... H01R 13/518 439/607.05
8,979,560 B2 * 3/2015 Kobayashi ..... H01R 13/62933 439/157
8,986,024 B2 * 3/2015 Ikeda ..... H01H 9/102 200/332

* cited by examiner

*Primary Examiner* — Khiem Nguyen
(74) *Attorney, Agent, or Firm* — Robert J. Myers

(57) ABSTRACT

An electromagnetically shielded connector system includes a first and second connector. The first connector further includes a first terminal and a first electromagnetic shield surrounding the first terminal. The first shield defines a flexible interface contact projecting from an end of the first shield. The second connector further includes a second terminal configured to mate with the first terminal and a second electromagnetic shield surrounding the second terminal. The second shield is configured to be electrically connected with the first shield at least via the flexible interface contact. The second shield is surrounded by a supporting member. At least a portion of an outer surface of the second shield is in intimate contact with the supporting member. The second shield is configured to be disposed intermediate the interface contact and the supporting member. The interface contact is formed and configured to exert a normal spring force on the second shield.

7 Claims, 5 Drawing Sheets

ELECTROMAGNETICALLY SHIELDED CONNECTOR SYSTEM

TECHNICAL FIELD OF THE INVENTION

The invention relates to an electrical connection system, particularly an electromagnetically shielded connector system.

BACKGROUND OF THE INVENTION

Electromagnetic compatibility (EMC) requires that electronic systems and equipment be able to tolerate a specified degree of interference and not generate more than a specified amount of electromagnetic interference (EMI). EMC is becoming more important because there are so many more opportunities today for EMC issues due to increased use of electronic devices e.g. in automotive, personal computing, entertainment, and communication applications. There is increased potential for EMI susceptibility in electronic devices due to lower supply voltages, higher clock frequencies that require faster slew rates, increased electronic packaging density. There is also an increased risk of generating EMI due to proximity of high voltage electrical systems, such as electric vehicle propulsion systems.

One approach to EMC is providing shielding against EMI. Options for electromagnetic shielding include forming a conductive enclosure around the electronic device, such as a metallic case or plastic case formed of a conductive plastic or coated with a conductive substance. The effectiveness of the electromagnetic shielding is typically limited by apertures and seams in the shield that may be required, examples of which are removable covers for access to the electronic device, ventilation holes, and openings required for control/display devices and electrical interconnection. Methods that may be employed to mitigate the shielding loss from apertures and seams include minimizing the size and number of apertures and seams, using conductive gaskets and/or flexible contacts to seal the interface between seams, maximizing the contact area at seams, and avoiding galvanic corrosion at seams.

High voltage cables in electrical vehicle propulsion system use shielded wire cables to mitigate emitted EMI. The continuity of the shielding must be preserved across interconnections of the cable, therefore the connectors for these shielded cables include shields surrounding the terminals of the connectors. In order for the connectors to be separable, the shields surrounding the terminals have at least two section which have a seam between them. The shields are typically interconnected by flexible contacts. The effectiveness of the shielding provided by the shields may depend on the normal spring force exerted by the flexible contacts of a first shield on a second mating shield, especially in a high vibration environment e.g., in an automobile. Such shields used in connectors are typically formed of sheet metal and the normal spring force exerted by the flexible contacts of a first shield be diminished by deformation of the sheet metal of the second shield caused by the flexible contacts, thus diminishing the electromagnetic shielding effectiveness of the connector system. Therefore, a connector system with improved electromagnetic shielding capability is desired.

The subject matter discussed in the background section should not be assumed to be prior art merely as a result of its mention in the background section. Similarly, a problem mentioned in the background section or associated with the subject matter of the background section should not be assumed to have been previously recognized in the prior art.

The subject matter in the background section merely represents different approaches, which in and of themselves may also be inventions.

BRIEF SUMMARY OF THE INVENTION

In accordance with an embodiment of the invention, an electromagnetically shielded electromagnetically shielded connector system is provided. The electromagnetically shielded connector system, includes a first connector and a second connector. The first connector further includes a first electrical terminal and a first electromagnetic shield longitudinally surrounding the first electrical terminal. The first electromagnetic shield defines a flexible interface contact longitudinally projecting from an end of the first electromagnetic shield. The second connector further includes a second electrical terminal configured to mate with the first electrical terminal and a second electromagnetic shield longitudinally surrounding the second electrical terminal. The second electromagnetic shield is configured to be electrically connected with the first electromagnetic shield at least via the flexible interface contact. The second electromagnetic shield is surrounded by a supporting member. At least a portion of an outer surface of the second electromagnetic shield is in intimate contact with the supporting member. The second electromagnetic shield is configured to be disposed intermediate the flexible interface contact and the supporting member. The flexible interface contact is formed and configured to exert a normal spring force on the second electromagnetic shield.

An entire outer surface of the second electromagnetic shield may be in intimate contact with the supporting member.

According to one particular embodiment, he second electromagnetic shield defines a rigid interface contact longitudinally projecting from an end of the second electromagnetic shield configured to interface with the flexible interface contact. The supporting member defines an extension projecting from an end of the supporting member and wherein the outer surface of the rigid interface contact is in intimate contact with the extension. The first connector defines a groove configured to receive the rigid interface contact and the extension.

The supporting member may also be configured to retain a complaint seal longitudinally surrounding the second connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is an electromagnetically shielded connector system that is designed to interconnect shielded wire cables, such as those used in the high voltage circuits of electrical vehicle propulsion system. The connector system include a pair of connectors, each having mating electrical terminals. An electromagnetic shield surrounds the terminals of each of the connectors. A first electromagnetic shield has at least one interface contact that projects from the end of the shield and contacts the second electromagnetic shield when the connectors are fully mated. The interface contact is configured to exert a normal spring force on the second electromagnetic shield. The second electromagnetic shield is surrounded by a rigid supporting member that is designed to inhibit outward flexing of the second electromagnetic shield thus maintaining the normal spring force between the interface contacts and the second electromagnetic shield.

Figure 1:
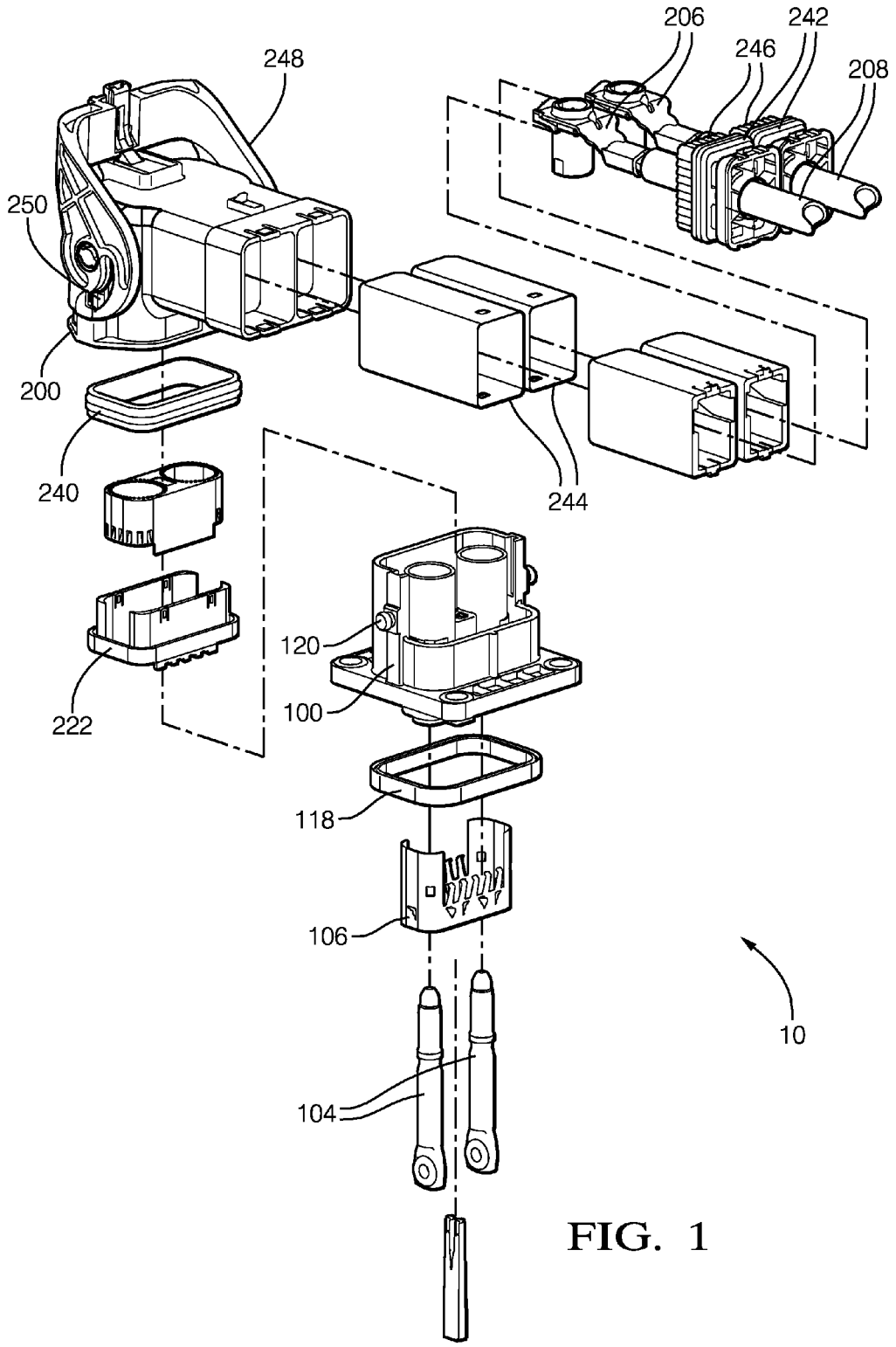
FIG. 1 is a perspective exploded view of an electromagnetically shielded connector assembly according to one embodiment.

FIG. 1 illustrates a non-limiting example of an electromagnetically shielded connector system 10, hereinafter referred to as the connector system 10. The connector system 10 includes a first connector 100 and a second connector 200.

Figures 2, 2A:
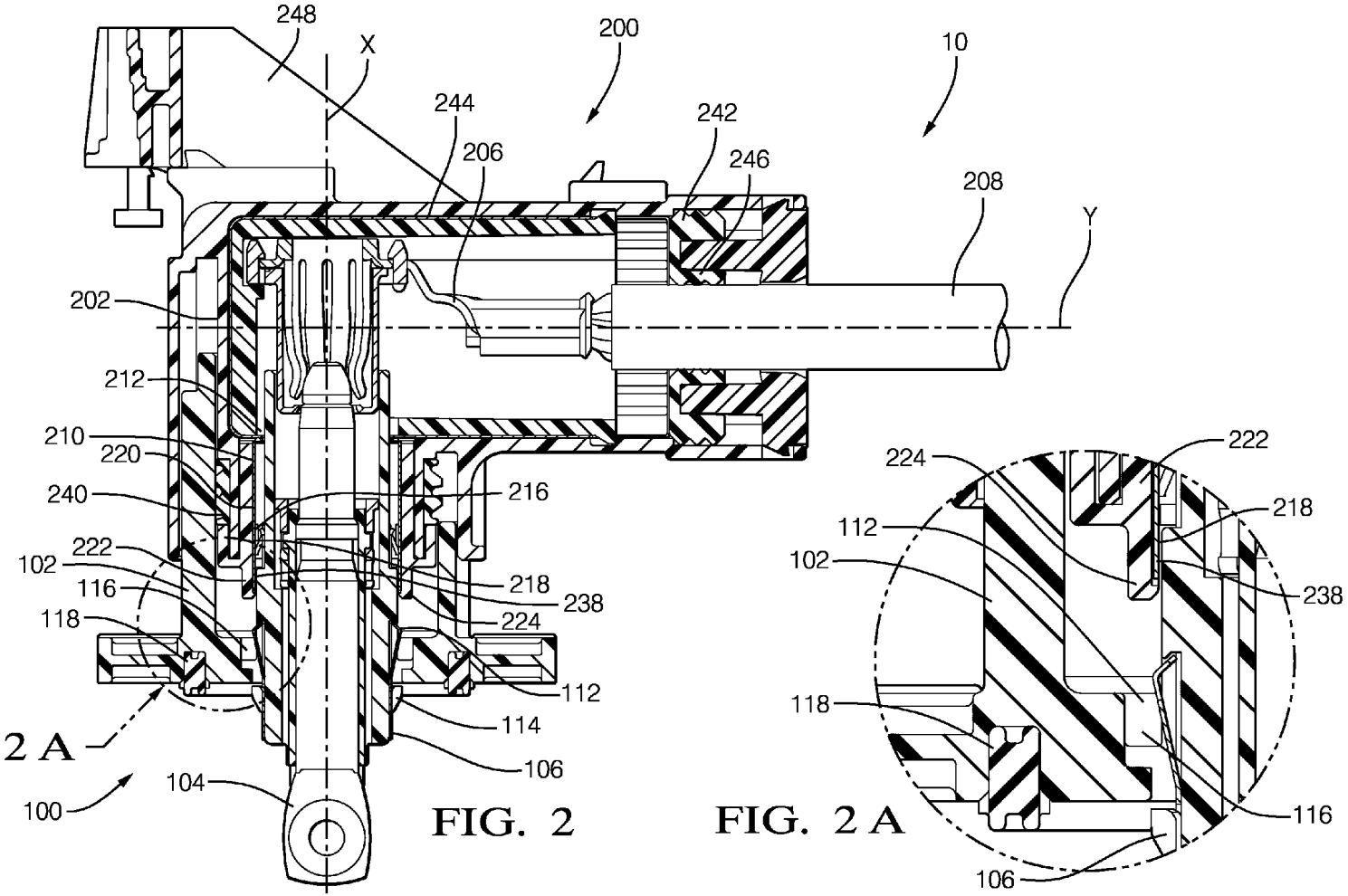
FIG. 2 is a cross sectional view of the electromagnetically shielded connector assembly of FIG. 1 in an unmated condition according to one embodiment.
FIG. 2A is a close up cross sectional view of the electromagnetically shielded connector assembly of FIG. 1 in an unmated condition according to one embodiment.
Figure 3:
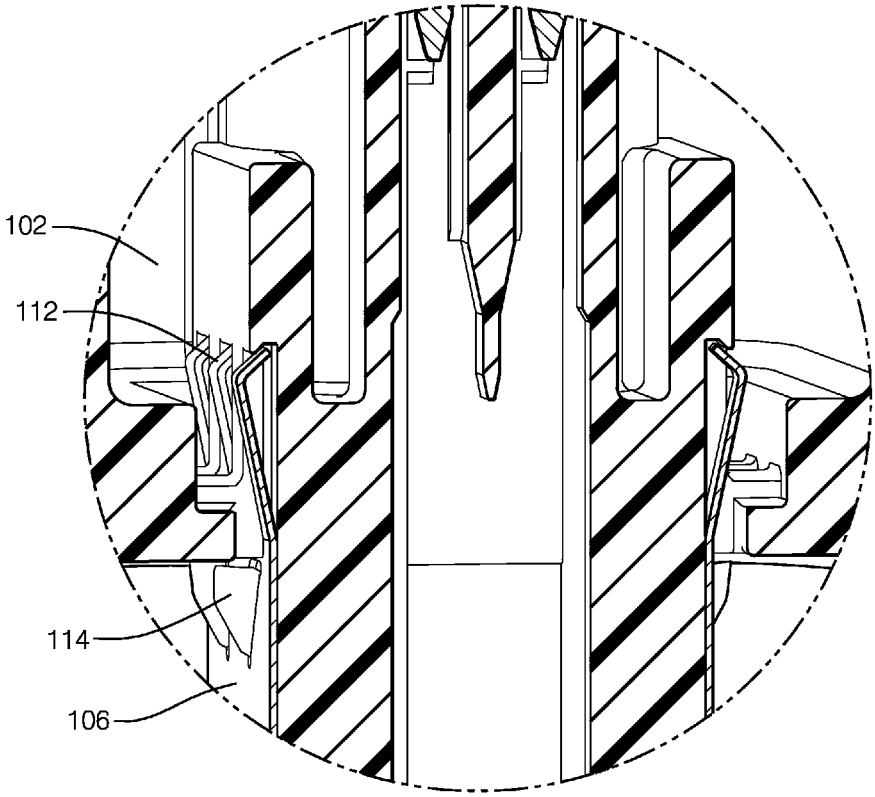
FIG. 3 is a close up perspective cross sectional view of flexible interface contacts of the electromagnetically shielded connector assembly of FIG. 1 in an unmated condition according to one embodiment.

The first connector 100 in the connector system 10 is a header connector 100. As illustrated in FIG. 2, the header connector 100 is based around a header connector body 102 formed of a dielectric polymeric material, such as polybutylene terephthalate (PBT), polypropylene (PP), or polyamide (PA, commonly known as NYLON). The header connector 100 includes a pair of conductive male pin terminals 104, hereinafter referred to as the male terminals 104, mounted within the header connector body 102. A first electromagnetic shield 106, hereinafter referred to as the first shield 106, is attached to the header body and longitudinally surrounds the male terminals 104 about a longitudinal axis X. The first shield 106 is formed of a sheet of conductive material, such as a tin plated copper alloy. Methods for forming such shields from sheet metal are well known to those skilled in the art. The first shield 106 has the form of a rectangular tube with openings defined by each end and rounded corners, although other shapes for the first shield 106 may be envisioned. As shown in FIGS. 2A and 3, the first shield 106 defines at least one flexible interface contact 112 that longitudinally projecting from one end of the first shield 106.

The header connector 100 is configured to be attached to the conductive bulkhead, in this example by conductive treaded fasteners (not shown). The first shield 106 may define flexible tabs 114 that are configured to establish an electrical connection between the bulkhead and the first shield 106. Alternatively, the first shield 106 may be electrically connected by a tab to a conductive boss surrounding an aperture though which the conductive fastener passes, thereby forming an electrical connection between the first shield 106 and the bulkhead.

Figures 4, 4A:
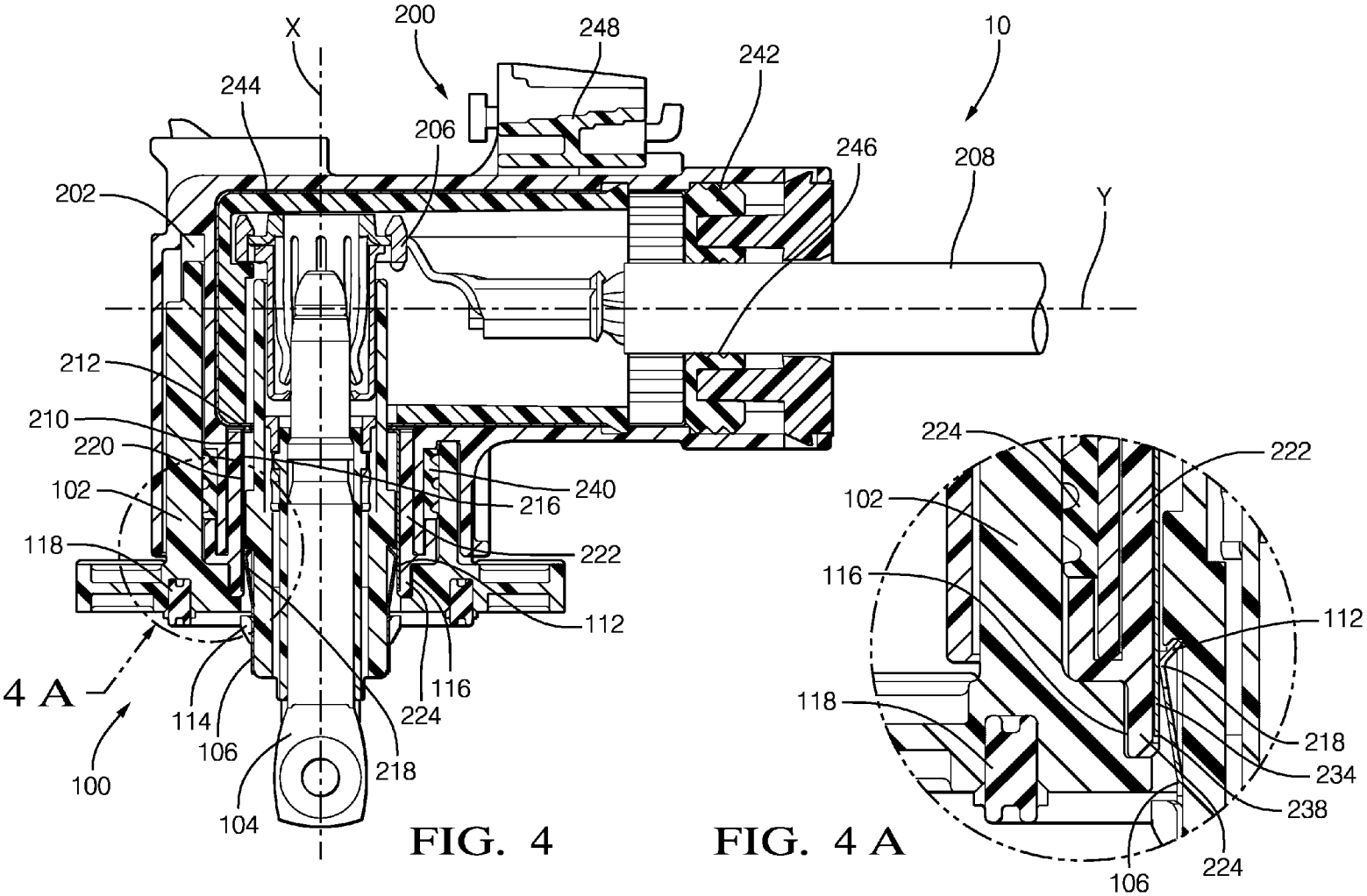
FIG. 4 is a cross sectional view of the electromagnetically shielded connector assembly of FIG. 1 in an unmated condition according to one embodiment.
FIG. 4A is a close up cross sectional view of the electromagnetically shielded connector assembly of FIG. 1 in an unmated condition according to one embodiment.

The second connector 200 in the electromagnetically shielded connector system 10 is the cable connector 200. As illustrated in FIG. 2, the cable connector 200 is based around a cable connector body 202 formed of a dielectric polymeric material, such as PBT, PP, or NYLON. The cable connector 200 includes a pair of conductive female socket terminals 206 connected to shielded wire cables 208, hereinafter referred to as the female terminals 206, mounted within the cable connector body 202. A second electromagnetic shield 210, hereinafter referred to as the second shield 210, longitudinally surrounds an aperture 212 along the longitudinal axis X surrounding a portion of the header connector body 102. The second shield 210 is formed of a sheet of conductive material, such as a tin plated copper alloy. The second shield 210 has the form of a rectangular tube with openings defined by each end and rounded corners and has a complementary shape to the first shield 106 and is configured to receive the first shield 106 within an inner wall 216 of the second shield 210. As shown in FIGS. 4 and 4A, when the first shield 106 is received within the second shield 210, the interface contacts 112 contact a contact area 218 on the inner wall 216 of the second shield 210, thereby making an electrical contact between the first and second shields 106, 210. The interface contacts 112 are formed to exert a normal spring force F on the contact area 218. Without subscribing to any particular theory of operation, a high normal spring force improves the EMC/EMI performance of the connection between the first and second shields 106, 210 in a higher vibration environment, such as that found in an automobile.

Figure 5:
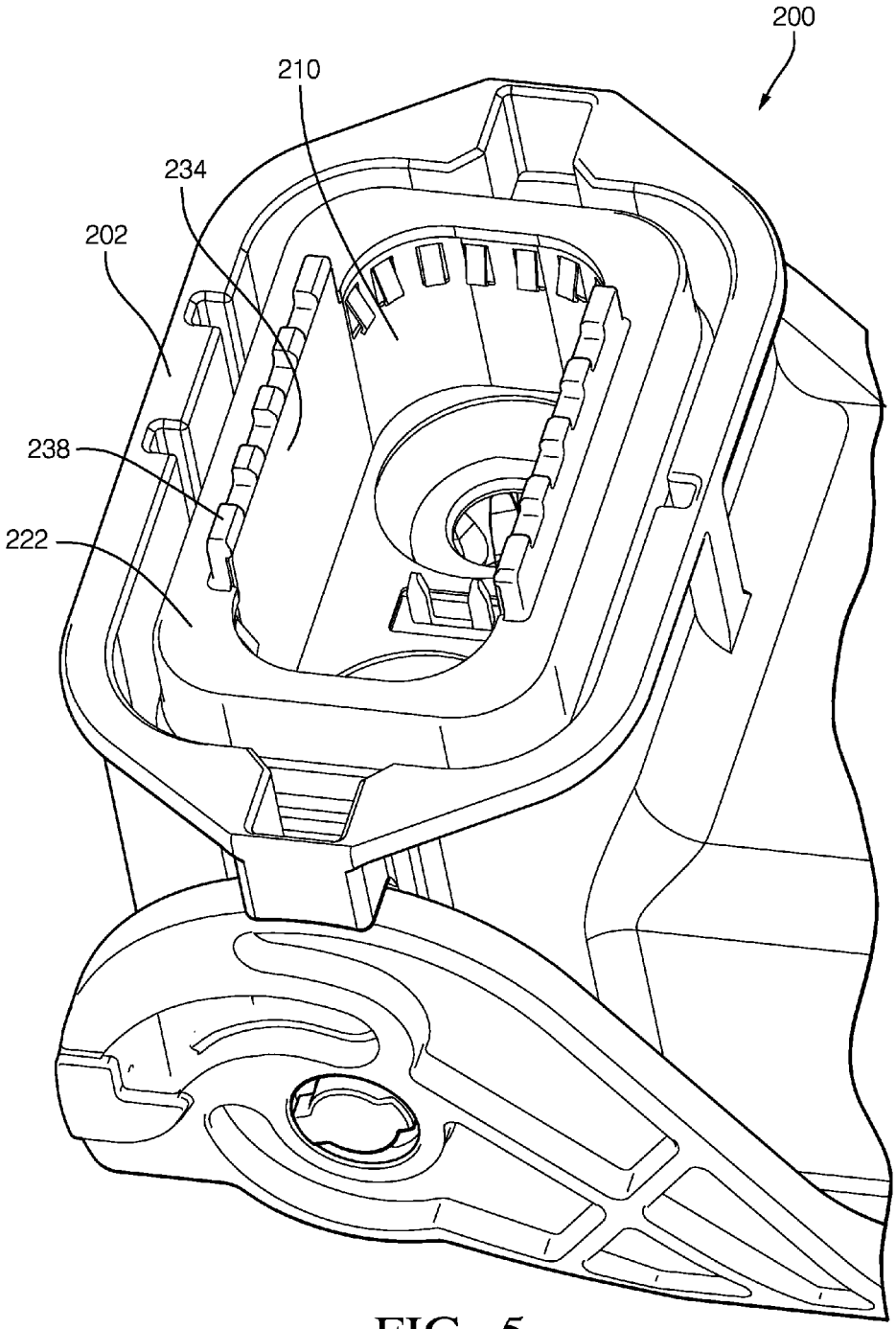
FIG. 5 is a perspective bottom view of the electromagnetically shielded connector assembly of FIG. 1 according to one embodiment.

As best shown in FIG. 5, an outer wall 220 of the second shield 210 is longitudinally surrounded by a rigid supporting member 222 along the longitudinal axis X. The supporting member 222 is also formed of a dielectric polymeric material, such as PBT, PP, or NYLON. The supporting member 222 is attached to the cable connector body 202. The second shield 210 is configured to be disposed intermediate the interface contact 112 and the supporting member 222. At least a portion of the outer wall 220 of the second shield 210 is in intimate contact with the supporting member 222 in the vicinity of the contact area 218. According to the illustrated example, the entire outer wall 220 of the second shield 210 is in intimate contact with the supporting member 222. Without subscribing to any particular theory of operation, the supporting member 222 inhibits flexing of the second shield 210 caused by the interface contacts 112, thus preventing a reduction in the normal spring force F between the interface contacts 112 and the second shield 210 and thereby improving the EMC/EMI performance as explained above.

According to the illustrated example and as shown in FIG. 4, the second shield 210 defines a pair of rigid interface tabs 224 longitudinally projecting from an end of the second shield 210 forming an intimal contact area 228 configured to interface with the interface contact 112. This interface tabs 224 is configured to make contact with the interface contacts 112 prior to contact between the male and female terminals 104, 206, thereby establishing a ground path between the shield 244 of the shielded wire cable 208 and the conductive bulkhead prior to establishing connection between the male and female terminals 206. The supporting member 222 defines an extension 234 projecting from an end of the supporting member 222. The outer surface 238 of the rigid interface tabs 224 are in intimate contact with the extension 234.

As shown in FIGS. 2 and 5, the header connector body 102 defines a groove 116 that is configured to receive the rigid interface tabs 224 and the extension 234 when the cable connector 200 is fully mated with the header connector 100.

The supporting member 222 is also configured to retain a complaint body seal 240 longitudinally surrounding the cable connector body 202 along the longitudinal axis X that is configured to provide an environmental seal between the cable connector body 202 and the header body. The connector system 10 also includes a header seal 118 configured to provide an environmental seal between the header connector body 102 and the bulkhead. The connector system 10 further includes compliant cable seals 242 between the shielded wire cables 208 and the cable connector body 202. These seals 118, 240, 242 are intended to seal out environmental contaminants for the interior of the header connector body 102 and the cable connector body 202 that may act as electrolytes and cause galvanic corrosion between the male and female terminals 104, 206 and/or the first and second shield 106, 210 that would degrade the current carrying performance and EMC/EMI performance of the connector system 10. The seals 118, 240, 242 may be formed of a silicone-based material.

The cable connector 200 shown in this example also includes a third electromagnetic shield 244, hereinafter referred to as the third shield 244, that is attached to the cable connector body 202 and longitudinally surrounds the female terminals 206 about a lateral axis Y. The third shield 244 defines the aperture 212 in which the second shield 210 is disposed. The third shield 244 is electrically connected to the shield 244 of the shielded wire cable 208, in this example by connective ferrules 246, to provide an electrical connected between the shield 244 of the shielded wire cable 208 and the bulkhead. The third shield 244 is formed of a sheet of conductive material, such as a tin plated copper alloy.

According to the connector system 10 shown here, the cable connector 200 further includes a mating assist lever 248 having mating grooves 250 that receive mating posts 120 defined by the header connector 100. The cable connector 200 and the header connecter are drawn from and unmated position as shown in FIG. 2 to a mated position as shown in FIG. 4 as the mating assist lever 248 is rotated from an open position to a closed position.

Accordingly an electromagnetically shielded connector system 10 is provided. The connector system 10 provides the benefit of improved EMC/EMI performance in high vibration environments, at least due to a supporting member 222 that increases the normal spring force of the connection between the interface contacts 112 of the first shield 106 and the second shield 210. The seals 118, 240, 242 of the connector system 10 inhibit the intrusion of environmental contacts that could cause galvanic corrosion.

While the connector system 10 illustrated herein is characterized as a right angle (ninety degree) header connector 100 assembly with a mating assist lever 248, features of this invention may also be applied to a straight (one hundred eighty degree) connector assembly. The features of this invention may also be applied to a connector assembly that neither includes a mating assist lever nor a header connector configured to be mounted to a conductive bulkhead but rather may include a second cable connector having male terminals.

While this invention has been described in terms of the preferred embodiments thereof, it is not intended to be so limited, but rather only to the extent set forth in the claims that follow. Moreover, the use of the terms first, second, upper, lower etc. does not denote any order of importance or location, but rather the terms first, second, upper, lower etc. are used to distinguish one element from another. Furthermore, the use of the terms a, an, etc. do not denote a limitation of quantity, but rather denote the presence of at least one of the referenced items.

We claim:

1. An electromagnetically shielded connector system, comprising:

a first connector, further comprising:

a first electrical terminal, and a first electromagnetic shield longitudinally surrounding the first electrical terminal, wherein the first electromagnetic shield defines a flexible interface contact longitudinally projecting from an end of the first electromagnetic shield; and a second connector, further comprising:

a second electrical terminal configured to mate with the first electrical terminal, and a second electromagnetic shield longitudinally surrounding the second electrical terminal and configured to be electrically connected with the first electromagnetic shield at least via the flexible interface contact, wherein the second electromagnetic shield is surrounded by a supporting member, wherein at least a portion of an outer surface of the second electromagnetic shield is in intimate contact with the supporting member, and wherein the second electromagnetic shield is configured to be disposed intermediate the flexible interface contact and the supporting member.

2. The electromagnetically shielded connector system according to claim 1, wherein the flexible interface contact is formed and configured to exert a normal spring force on the second electromagnetic shield.

3. The electromagnetically shielded connector system according to claim 1, wherein an entire outer surface of the second electromagnetic shield is in intimate contact with the supporting member.

4. The electromagnetically shielded connector system according to claim 1, wherein the second electromagnetic shield defines a rigid interface contact longitudinally projecting from an end of the second electromagnetic shield configured to interface with the flexible interface contact.

5. The electromagnetically shielded connector system according to claim 4, wherein the supporting member defines an extension projecting from an end of the supporting member and wherein the outer surface of the rigid interface contact is in intimate contact with the extension.

6. The electromagnetically shielded connector system according to claim 5, wherein the first connector defines a groove configured to receive the rigid interface contact and the extension.

7. The electromagnetically shielded connector system according to claim 1, wherein the supporting member is also configured to retain a compliant seal longitudinally surrounding the second connector.

* * * * *